US010161366B2

(12) United States Patent
Ito

(10) Patent No.: US 10,161,366 B2
(45) Date of Patent: Dec. 25, 2018

(54) AIR INTAKE APPARATUS

(71) Applicant: AISIN SEIKI KABUSHIKI KAISHA, Kariya-shi, Aichi-ken (JP)

(72) Inventor: Atsushi Ito, Anjo (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 0 days.

(21) Appl. No.: 15/703,392

(22) Filed: Sep. 13, 2017

(65) Prior Publication Data

US 2018/0149120 A1 May 31, 2018

(30) Foreign Application Priority Data

Nov. 30, 2016 (JP) ..... 2016-233136

(51) Int. Cl.

| | |
|---|---|
| ***F02M 26/00*** | (2016.01) |
| ***F02M 35/104*** | (2006.01) |
| ***F02M 26/13*** | (2016.01) |
| ***F02M 35/10*** | (2006.01) |
| ***F02M 35/112*** | (2006.01) |

(52) U.S. Cl.

CPC ..... *F02M 35/1045* (2013.01); *F02M 26/13* (2016.02); *F02M 35/10091* (2013.01); *F02M 35/10222* (2013.01); *F02M 35/112* (2013.01)

(58) Field of Classification Search

CPC ..... F02M 35/1045; F02M 35/10091; F02M 35/10222; F02M 35/112; F02M 26/13

See application file for complete search history.

(56) References Cited

U.S. PATENT DOCUMENTS 7,305,958 B2 12/2007 Doko et al.
2013/0306041 A1* 11/2013 Koga ..... F02M 25/07 123/568.11
2014/0014056 A1* 1/2014 Sato ..... F02M 35/10072 123/184.47

(Continued)

FOREIGN PATENT DOCUMENTS

JP 2000-8968 A 1/2000
JP 2006-241992 A 9/2006

*Primary Examiner* — Thomas Moulis
(74) *Attorney, Agent, or Firm* — Buchanan Ingersoll & Rooney PC

(57) ABSTRACT

An air intake apparatus includes: an air intake apparatus body including first, second, third and fourth air intake passages respectively provided corresponding to first, second, third and fourth cylinders of a multi-cylinder engine which has one or a plurality of groups of four consecutive cylinders of the first, second, third and fourth cylinders, the multi-cylinder engine having an air intake sequence of the first cylinder, the third cylinder, the fourth cylinder, and the second cylinder; and a distribution passage through which external gas is distributed to the first, second, third and fourth air intake passages. The distribution passage includes an upstream distribution passage, first and second midstream distribution passages branched off from the upstream distribution passage, and first and second downstream distribution passages branched off from the first midstream distribution passage, and third and fourth downstream distribution passages branched off from the second midstream distribution passage.

5 Claims, 5 Drawing Sheets

(56) References Cited

U.S. PATENT DOCUMENTS

| | | | | |
|---|---|---|---|---|
| 2014/0326226 | A1* | 11/2014 | Senda | F01M 13/0011 123/573 |
| 2015/0252755 | A1* | 9/2015 | Sato | F02B 27/0215 123/568.29 |
| 2017/0241377 | A1* | 8/2017 | Ito | F02M 35/112 |
| 2017/0306895 | A1* | 10/2017 | Teramoto | F02M 35/104 |
| 2018/0045150 | A1* | 2/2018 | Ito | F02M 35/10222 |
| 2018/0119655 | A1* | 5/2018 | Ito | F02M 35/104 |

* cited by examiner

FIG.5

| | | | | | |
|---|---|---|---|---|---|
| FIRST CYLINDER | EXHAUST STROKE | INTAKE STROKE | COMPRESSION STROKE | COMBUSTION STROK | EXHAUST STROKE |
| SECOND CYLINDER | INTAKE STROKE | COMPRESSION STROKE | COMBUSTION STROK | EXHAUST STROKE | INTAKE STROKE |
| THIRD CYLINDER | COMBUSTION STROKE | EXHAUST STROKE | INTAKE STROKE | COMPRESSION STROKE | COMBUSTION STROK |
| FOURTH CYLINDER | COMPRESSION STROKE | COMBUSTION STROK | EXHAUST STROKE | INTAKE STROKE | COMPRESSION STROKE |

P1 P2 P3 P4 TIME

FIG.6

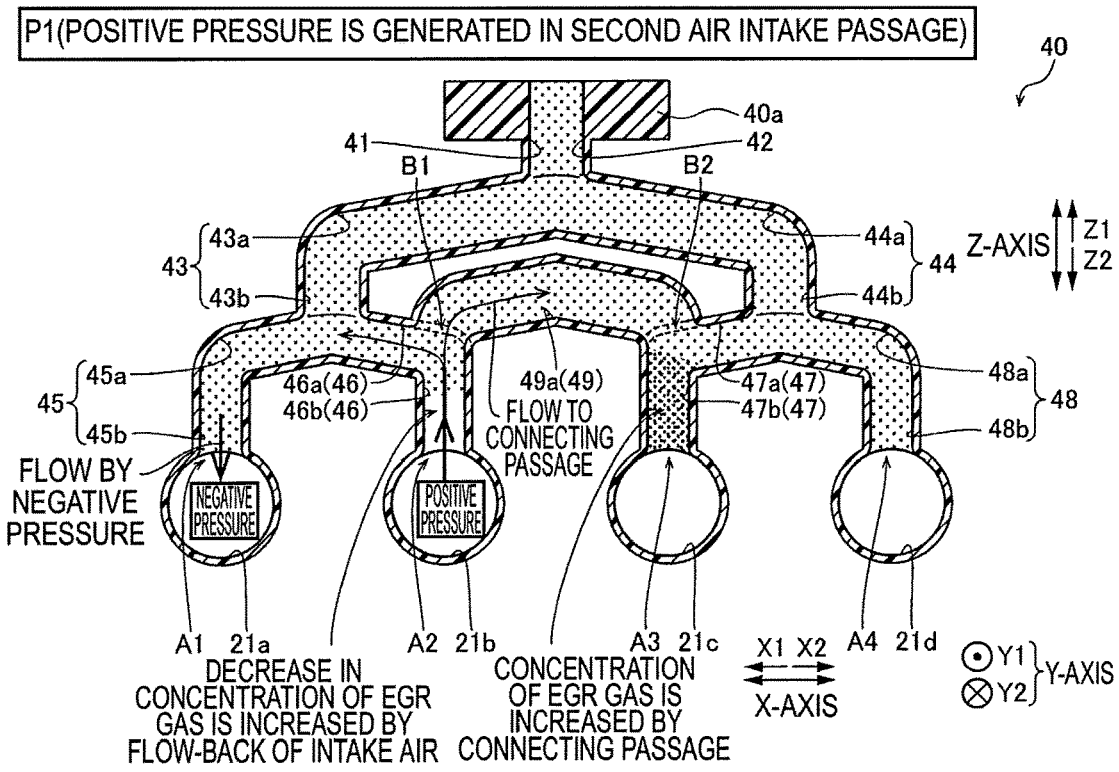

AIR INTAKE APPARATUS

CROSS REFERENCE TO RELATED APPLICATIONS

This application is based on and claims priority under 35 U.S.C. § 119 to Japanese Patent Application 2016-233136, filed on Nov. 30, 2016, the entire contents of which are incorporated herein by reference.

TECHNICAL FIELD

This disclosure relates to an air intake apparatus.

BACKGROUND DISCUSSION

In the related art, there has been known an air intake apparatus including a distribution passage through which external gas is distributed to a plurality of cylinders (for example, JP 2006-241992A (Reference 1)).

In above-described Reference 1, an air intake manifold (air intake apparatus) for guiding air to four consecutive cylinders of an engine is disclosed. The air intake manifold disclosed in Reference 1 includes four branch pipes (air intake passage) and a gas passage (distribution passage) for returning blow-by gas (external gas) to the engine. The gas passage is formed so as to branch stepwise (1→2→4) and extend from a gas introduction port into which the blow-by gas is introduced to the four branch pipes. That is, the gas passage is formed in a so-called tournament branch shape. Therefore, the air intake manifold is configured such that the blow-by gas is distributed to each of the four branch pipes and cylinders.

However, the inventor of the present application has found a problem that variation occurs in the distribution of the blow-by gas to the four consecutive cylinders depending on operating conditions of the engine even in a case where the gas passage is formed in the tournament branch shape in the air intake manifold disclosed in Reference 1. Therefore, in the gas passage formed in the tournament branch shape, it is desired to provide an air intake manifold capable of effectively suppressing occurrence of the variation in the distribution of the blow-by gas to the four consecutive cylinders.

Thus, a need exists for an air intake apparatus which is not susceptible to the drawback mentioned above.

SUMMARY

An air intake apparatus according to an aspect of this disclosure includes: an air intake apparatus body that includes a first air intake passage, a second air intake passage, a third air intake passage, and a fourth air intake passage respectively provided corresponding to a first cylinder, a second cylinder, a third cylinder, and a fourth cylinder of a multi-cylinder engine which has one or a plurality of groups of four consecutive cylinders of the first cylinder, the second cylinder, the third cylinder, and the fourth cylinder, the multi-cylinder engine having an air intake sequence of the first cylinder, the third cylinder, the fourth cylinder, and the second cylinder; and a distribution passage through which external gas is distributed to the first air intake passage, the second air intake passage, the third air intake passage, and the fourth air intake passage. The distribution passage includes an upstream distribution passage, a first midstream distribution passage and a second midstream distribution passage which are branched off from the upstream distribution passage, a first downstream distribution passage and a second downstream distribution passage which are branched off from the first midstream distribution passage, and a third downstream distribution passage and a fourth downstream distribution passage which are branched off from the second midstream distribution passage. The first downstream distribution passage, the second downstream distribution passage, the third downstream distribution passage, and the fourth downstream distribution passage are respectively connected to the first air intake passage, the second air intake passage, the third air intake passage, and the fourth air intake passage. The distribution passage further includes a connecting passage that connects the second downstream distribution passage with the third downstream distribution passage adjacent to the second downstream distribution passage.

BRIEF DESCRIPTION OF THE DRAWINGS

The foregoing and additional features and characteristics of this disclosure will become more apparent from the following detailed description considered with the reference to the accompanying drawings, wherein:

FIG. 5 is a table illustrating a stroke order of each cylinder of the in-line four-cylinder engine of an embodiment disclosed here;

FIG. 6 is a schematic sectional view for explaining a behavior of EGR gas in a distribution passage in a period P1 of the in-line four-cylinder engine of an embodiment disclosed here;

DETAILED DESCRIPTION

Figure 1:
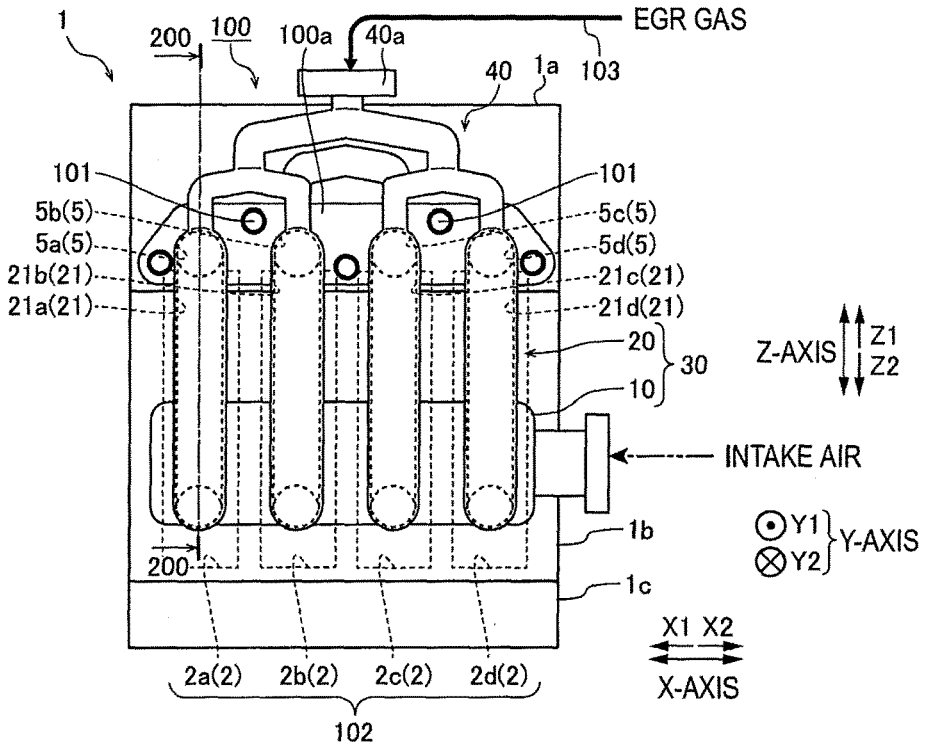
FIG. 1 is a schematic view illustrating a state where an air intake apparatus of an embodiment disclosed here is attached to an in-line four-cylinder engine.

Hereinafter, an embodiment disclosed here will be described with reference to the drawings.

A configuration of an air intake apparatus 100 by an example disclosed here will be described with reference to FIGS. 1 to 3. Moreover, in the embodiment, in a case where an in-line four-cylinder engine 1 is used as a reference, each cylinder 2 is disposed along an X-axis direction and a direction orthogonal to the X-axis in a horizontal plane is a Y-axis direction. In addition, the description will be given in which an upward and downward direction is a Z-axis direction in a state where the air intake apparatus 100 (in-line four-cylinder engine 1) is mounted on a vehicle (not illustrated). Moreover, the in-line four-cylinder engine 1 is an example of the "multi-cylinder engine" of the claims.

Configuration of In-line Four-cylinder Engine

The in-line four-cylinder engine 1 includes a cylinder head 1 a, a cylinder block 1*b*, and a crankcase 1*c*. In addition, the in-line four-cylinder engine 1 is provided with four cylinders 2. One group of a cylinder group 102 is formed by the four cylinders 2. The four cylinders 2 are arranged in series in the order of a first cylinder 2*a*, a second cylinder 2*b*, a third cylinder 2*c*, and a fourth cylinder 2*d* from an X1 direction to an X2 direction.

In addition, the in-line four-cylinder engine 1 is a so-called four-stroke engine. That is, in the in-line four-cylinder engine 1, a series of strokes including an intake stroke, a compression stroke, a combustion stroke, and an exhaust stroke in the cylinder 2 is performed while a piston 3 makes two reciprocations in the cylinder 2.

Figure 4:
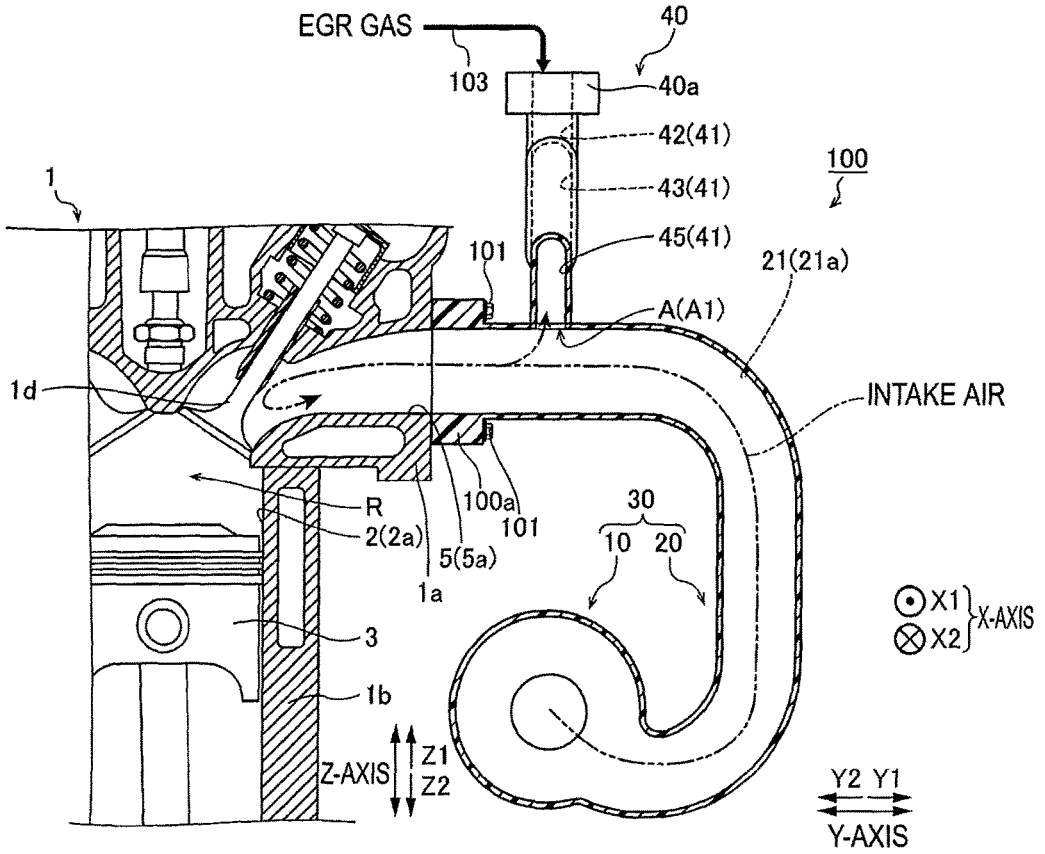
FIG. 4 is a partial sectional view illustrating a cylinder immediately after the intake stroke of the in-line four-cylinder engine, which is taken along line II-II of FIG. 1.

In addition, in the in-line four-cylinder engine 1, the first cylinder 2*a*, the third cylinder 2*c*, the fourth cylinder 2*d*, and the second cylinder 2*b* are ignited in this order (see FIG. 5). That is, as illustrated in FIG. 4, the in-line four-cylinder engine 1 is configured such that an intake sequence is in the order of the first cylinder 2*a*, the third cylinder 2*c*, the fourth cylinder 2*d*, and the second cylinder 2*b*.

Configuration of Air Intake Apparatus

Figure 2:
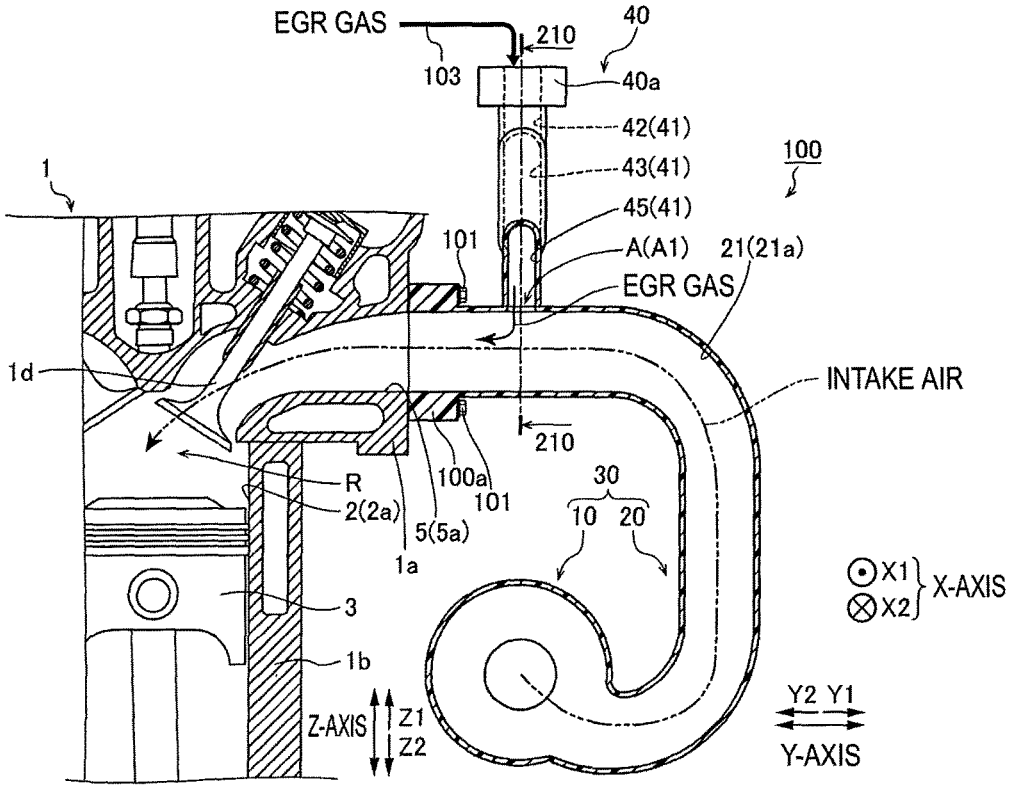
FIG. 2 is a partial sectional view illustrating a cylinder of a state where the in-line four-cylinder engine is in an intake stroke, which is taken along line II-II of FIG. 1.

As illustrated in FIGS. 1 and 2, the air intake apparatus 100 is fixed to a side surface portion of the in-line four-cylinder engine 1 on a side of an Y1 direction. The air intake apparatus 100 includes an air intake apparatus body 30 including a surge tank 10 and an air intake passage portion 20 disposed downstream of the surge tank 10. The air intake apparatus body 30 (the surge tank 10 and the air intake passage portion 20) is made of resin. In addition, the air intake apparatus body 30 may be configured by joining a plurality of different resin members to each other by vibration welding or the like.

The air intake apparatus 100 has a flange portion 100*a* for fixing the air intake apparatus 100 to the cylinder head 1*a* of the in-line four-cylinder engine 1. As illustrated in FIG. 3, insertion holes 100*b* into which fastening members 101 (see FIG. 1) such as bolts or the like are inserted are formed in the flange portion 100*a*. The fastening members 101 are fastened to screw holes (not illustrated) of the cylinder head la in a state where the fastening members 101 are fastened to the insertion holes 100*b* and thereby the air intake apparatus 100 is fixed to the side surface portion of the in-line four-cylinder engine 1 on the side of the Y1 direction.

The air intake passage portion 20 serves to distribute intake air stored in the surge tank 10 to the corresponding cylinder 2. Moreover, a side in a direction of an arrow Z2 in the air intake passage portion 20 is an air intake upstream side of connected to the surge tank 10 and a side in a direction of an arrow Z1 is an air intake downstream side of connected to the in-line four-cylinder engine 1 (cylinder head 1*a*).

In addition, the in-line four-cylinder engine 1 is configured such that exhaust gas recirculation (EGR) gas that is a part of exhaust gas discharged from a combustion chamber R of each cylinder 2 is recirculated via the air intake apparatus 100. In addition, an EGR gas pipe (not illustrated) branched off from an exhaust gas pipe (not illustrated) of the in-line four-cylinder engine 1 is connected to a flange portion 40*a* of a distribution passage portion 40 which is described later. In addition, the EGR gas contains moisture (water vapor). Moreover, the EGR gas is an example of the "external gas" of the claims.

In addition, the surge tank 10 is formed so as to extend along the X-axis direction. In addition, the surge tank 10 is configured such that the intake air is introduced inside the surge tank 10 from an end portion thereof in the X2 direction. In addition, four air intake passages 21 (the air intake passage 21*a*, an air intake passage 21*b*, an air intake passage 21*c*, and an air intake passage 21*d*) through which the intake air circulates are formed in the air intake passage portion 20. As illustrated in FIG. 2, the air intake passages 21*a* to 21*d* are disposed along the X-axis direction and are disposed in this order from the side in the X1 direction to the side in the X2 direction. The air intake passage 21*a*, the air intake passage 21*b*, the air intake passage 21*c*, and the air intake passage 21*d* are respectively an example of the "first air intake passage", the "second air intake passage", the "third air intake passage", and the "fourth air intake passage" of the claims.

As illustrated in FIG. 1, one end (side in a Z2 direction) of the air intake passage 21 is connected to the surge tank 10. In addition, the other end (side in the Z1 direction) of the air intake passage 21 is connected to an air intake port 5 corresponding to each cylinder 2. Specifically, the other end of the air intake passage 21*a* is connected to a first air intake port 5*a* corresponding to the first cylinder 2*a*. The other end of the air intake passage 21*b* is connected to a second air intake port 5*b* corresponding to the second cylinder 2*b*. The other end of the air intake passage 21*c* is connected to a third air intake port 5*c* corresponding to the third cylinder 2*c*. The other end of the air intake passage 21*d* is connected to a fourth air intake port 5*d* corresponding to the fourth cylinder 2*d*. Moreover, in FIG. 2, although the first air intake port 5*a* and the air intake passage 21*a* are only illustrated, the second air intake port 5*b* and the air intake passage 21*b*, the third air intake port 5*c* and the air intake passage 21*c*, the fourth air intake port 5*d* and the air intake passage 21*d* are not illustrated because of having the same configuration as those of the first air intake port 5*a* and the air intake passage 21*a*.

Figure 3:
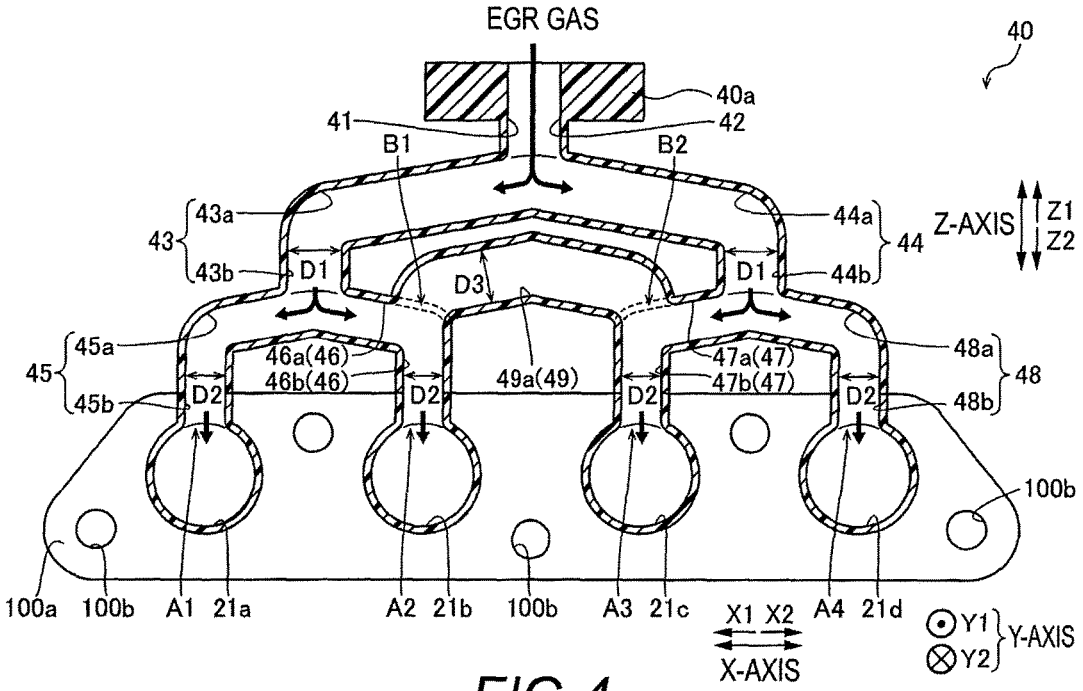
FIG. 3 is a sectional view of the air intake apparatus which is taken along line of FIG. 2.

As illustrated in FIGS. 1 to 3, the air intake apparatus 100 further includes the distribution passage portion 40. The distribution passage portion 40 is provided on the Z1 direction side of the air intake passage portion 20. The distribution passage portion 40 has a function of distributing the EGR gas recirculated to the in-line four-cylinder engine 1 to the air intake passage 21 corresponding to each cylinder 2.

In addition, the distribution passage portion 40 is formed integrally with the air intake apparatus body 30. In addition, the distribution passage portion 40 is made of the same resin as the air intake apparatus body 30. Therefore, the weight of the air intake apparatus body 30, in which the distribution passage portion 40 is provided, is reduced. Moreover, the distribution passage portion 40 is integrated with the air intake apparatus body 30 by being joined to the air intake apparatus body 30 made of different resin member by vibration welding or the like. In addition, the distribution passage portion 40 may be configured by joining a plurality of divided resin members by vibration welding or the like.

Configuration of Distribution Passage Portion

As illustrated in FIGS. 2 and 3, the distribution passage portion 40 is a tubular member (pipe member) having a distribution passage 41 therein. In addition, the distribution passage portion 40 has the flange portion 40*a* provided at an upper portion thereof. The flange portion 40*a* is provided to connect the EGR gas pipe (not illustrated) to the distribution passage portion 40.

As illustrated in FIG. 3, the distribution passage 41 has the tournament branch shape which branches in a two-step tournament form (1→2→4). That is, the distribution passage 41 includes one upstream distribution passage 42 and a pair of midstream distribution passages 43 and 44 connected to the upstream distribution passage 42 as the tournament branch shape of a first stage. In addition, the distribution passage 41 includes a pair of downstream distribution passages 45 and 46 connected to the midstream distribution passage 43 and a pair of downstream distribution passages 47 and 48 connected to the midstream distribution passage 44 as the tournament branch shape of a second stage. Moreover, the midstream distribution passages 43 and 44 are respectively an example of the "first midstream distribution passage" and the "second midstream distribution passage" of the claims. In addition, the downstream distribution passages 45, 46, 47, and 48 are respectively an example of the "first downstream distribution passage", the "second downstream distribution passage", the "third downstream distribution passage", and the "fourth downstream distribution passage" of the claims.

As a result, the distribution passage 41 is configured such that the EGR gas introduced into the upstream distribution passage 42 is distributed to each of the pair of midstream distribution passages 43 and 44. The distribution passage 41 is configured such that the EGR gas distributed to the midstream distribution passage 43 is distributed to each of the pair of downstream distribution passages 45 and 46, and the EGR gas distributed to the midstream distribution passage 44 is distributed to each of the pair of downstream distribution passages 47 and 48. That is, the distribution passage 41 is configured such that the upstream distribution passage 42 is positioned at the most upstream in a circulation direction of the EGR gas, and the downstream distribution passages 45 to 48 are positioned at the most downstream in the circulation direction of the EGR gas.

The upstream distribution passage 42 is formed to extend from an upper side (Z1 direction) toward a lower side (Z2 direction). An end portion of the upstream distribution passage 42 on the upstream side (Z1 direction side) is connected to an EGR gas passage 103 in the pipe of the EGR gas pipe (not illustrated). An end portion of the upstream distribution passage 42 on the downstream side (Z2 direction side) is connected to the pair of midstream distribution passages 43 and 44 which are branched off.

The midstream distribution passage 43 is configured with a midstream distribution passage portion 43*a* extending from the end portion of the upstream distribution passage 42 on the Z2 direction side toward the X1 direction side (downstream side), and a midstream distribution passage portion 43*b* extending downward from the end portion of the midstream distribution passage portion 43*a* on the X1 direction side. In addition, the midstream distribution passage portion 43*a* is inclined downward toward the X1 direction side. As a result, the midstream distribution passage 43 as a whole is formed to be downward from the upstream toward the downstream. In addition, a diameter (inner diameter) D1 of the midstream distribution passage 43 is substantially equal through the entire midstream distribution passage 43.

Similarly, the midstream distribution passage 44 is configured with a midstream distribution passage portion 44*a* extending from the end portion of the upstream distribution passage 42 on the Z2 direction side toward the X2 direction side (downstream side), and a midstream distribution passage portion 44*b* extending downward (Z2 direction) from the end portion of the midstream distribution passage portion 44*a* on the X2 direction side. In addition, the midstream distribution passage portion 44*a* is inclined downward toward the X2 direction side. As a result, the midstream distribution passage 44 as a whole is formed to be downward from the upstream toward the downstream. In addition, a diameter (inner diameter) D1 of the midstream distribution passage 44 is substantially equal through the entire midstream distribution passage 44 and is substantially equal to the diameter D1 of the midstream distribution passage 43.

The downstream distribution passage 45 is configured with a downstream distribution passage portion 45*a* extending from the end portion of the midstream distribution passage 43 on the Z2 direction side toward the X1 direction side (downstream side), and a downstream distribution passage portion 45*b* extending downward (Z2 direction) from the end portion of the downstream distribution passage portion 45*a* on the X1 direction side and connected to the air intake passage 21*a*. In addition, the downstream distribution passage portion 45*a* is inclined downward toward the X1 direction side. As a result, the downstream distribution passage 45 as a whole is formed to be downward from the upstream toward the downstream. In addition, a diameter (inner diameter) D2 of the downstream distribution passage 45 is substantially equal through the entire downstream distribution passage 45.

The downstream distribution passage 46 is configured with a downstream distribution passage portion 46*a* extending from the end portion of the midstream distribution passage 43 on the Z2 direction side toward the X2 direction side (downstream side), and a downstream distribution passage portion 46*b* extending downward (Z2 direction) from the end portion of the downstream distribution passage portion 46*a* on the X2 direction side and connected to the air intake passage 21*b*. The downstream distribution passage portion 46*a* is inclined downward toward the X2 direction side. As a result, the downstream distribution passage 46 as a whole is formed to be downward from the upstream toward the downstream. In addition, a diameter (inner diameter) D2 of the downstream distribution passage 46 is substantially equal through the entire downstream distribution passage 46.

The downstream distribution passage 47 is configured with a downstream distribution passage portion 47*a* extending from the end portion of the midstream distribution passage 44 on the Z2 direction side toward the X1 direction side (downstream side), and a downstream distribution passage portion 47*b* extending downward (Z2 direction) from the end portion of the downstream distribution passage portion 47*a* on the X1 direction side and connected to the air intake passage 21*c*. The downstream distribution passage portion 47*a* is inclined downward toward the X1 direction side. As a result, the downstream distribution passage 47 as a whole is formed to be downward from the upstream toward the downstream. In addition, a diameter (inner diameter) D2 of the downstream distribution passage 47 is substantially equal through the entire downstream distribution passage 47.

The downstream distribution passage 48 is configured with a downstream distribution passage portion 48*a* extending from the end portion of the midstream distribution passage 44 on the Z2 direction side toward the X2 direction side (downstream side), and a downstream distribution passage portion 48*b* extending downward (Z2 direction) from the end portion of the downstream distribution passage portion 48*a* on the X2 direction side and connected to the air intake passage 21*d*. The downstream distribution passage portion 48*a* is inclined downward toward the X2 direction side. As a result, the downstream distribution passage 48 as a whole is formed to be downward from the upstream toward the downstream. In addition, a diameter (inner diameter) D2 of the downstream distribution passage 48 is substantially equal through the entire downstream distribution passage 48. In addition, the diameters (inner diameters) D2 of the downstream distribution passages 45 to 48 are substantially equal to each other.

The diameters D2 of the downstream distribution passages 45 to 48 are smaller than the diameters D1 of the midstream distribution passages 43 and 44. As a result, the passage cross-sectional areas (cross-sectional areas in a direction orthogonal to the circulation direction of the EGR gas) of the downstream distribution passages 45 to 48 are smaller than the passage cross-sectional areas of the midstream distribution passages 43 and 44.

In addition, the downstream distribution passages 45 to 48 and the air intake passages 21*a* to 21*d* are connected to each other at connecting positions A1 to A4. The connecting positions A1 to A4 are respectively the lower ends of the downstream distribution passages 45 to 48 and are the upper ends of the air intake passages 21*a* to 21*d*.

In addition, the downstream distribution passages 45 to 48 are disposed in the order of the downstream distribution passages 45, 46, 47, and 48 from the X1 direction side to the X2 direction side so as to correspond to the air intake passages 21*a* to 21*d*. That is, the downstream distribution passage 46 and the downstream distribution passage 47 are respectively connected to different midstream distribution passages, and are disposed at positions adjacent to each other.

Here, in the embodiment, the distribution passage 41 further includes a connecting passage 49 connecting the downstream distribution passage 46 and the downstream distribution passage 47. The connecting passage 49 is formed to extend in the X-axis direction so as to connect the downstream distribution passage 46 and the downstream distribution passage 47. In addition, a connecting position B1 between the downstream distribution passage 46 and the connecting passage 49 is located in the vicinity of the connecting position between the downstream distribution passage portion 46*a* and the downstream distribution passage portion 46*b* of the downstream distribution passage 46. The connecting position B1 is formed at a position facing a connecting position A2 between the downstream distribution passage 46 and the air intake passage 21*b* in the Z-axis direction. Moreover, the connecting position B1 is formed just above the connecting position A2.

Similarly, a connecting position B2 between the downstream distribution passage 47 and the connecting passage 49 is located in the vicinity of the connecting position between the downstream distribution passage portion 47*a* and the downstream distribution passage portion 47*b* of the downstream distribution passage 47. The connecting position B2 is formed at a position facing a connecting position A3 between the downstream distribution passage 47 and the air intake passage 21*c* in the Z-axis direction. Moreover, the connecting position B2 is formed just above the connecting position A3.

A diameter (inner diameter) D3 of the connecting passage 49 is substantially equal through the entire connecting passage 49. In addition, the diameter (inner diameter) D3 of the connecting passage 49 is equal to or larger than the diameters D1 of the midstream distribution passages 43 and 44, and is larger than the diameters D2 of the downstream distribution passages 45 to 48. That is, the passage cross-sectional area of the connecting passage 49 is equal to or larger than the passage cross-sectional areas of the midstream distribution passages 43 and 44 and is larger than the passage cross-sectional areas of the downstream distribution passages 45 to 48.

In addition, the connecting passage 49 is formed to be inclined downward (Z2 direction) from a center portion 49*a* toward the connecting position B1 (X1 direction side) in the X-axis direction, and inclined downward from the center portion 49*a* toward the connecting position B2 (X2 direction side). That is, the center portion 49*a* is not only located at a position higher than the connecting positions B1 and B2, but also located at the uppermost position (high position) in the connecting passage 49.

Next, a state of the intake stroke of a predetermined cylinder 2 will be described with reference to FIG. 2.

In the intake stroke in the predetermined cylinder 2, an intake valve 1*d* corresponding to the predetermined cylinder 2 of the in-line four-cylinder engine 1 is opened and thereby the combustion chamber R of the predetermined cylinder 2 is opened. Therefore, intake air (mixture of the EGR gas and the intake air) is introduced into the combustion chamber R of the predetermined cylinder 2. In this case, a negative pressure is generated in the air intake passage 21 corresponding to the predetermined cylinder 2. Moreover, the negative pressure in the air intake passage 21 is greatest in the first half of the intake stroke.

Next, a state immediately after the intake stroke of the predetermined cylinder 2 will be described with reference to FIG. 4.

When the intake stroke is completed in the predetermined cylinder 2, the intake valve 1*d* corresponding to the predetermined cylinder 2 of the in-line four-cylinder engine 1 is closed and the combustion chamber R of the predetermined cylinder 2 is closed. Therefore, the intake air in the air intake passage 21 flowing toward the inside of the combustion chamber R is reflected by the negative pressure in the intake valve 1*d* which closes the combustion chamber R immediately after the completion of the intake stroke. As a result, in the air intake passage 21 corresponding to the predetermined cylinder 2, a positive pressure is generated and the intake air flows backward. That is, the intake air pulsation (inertia effect of the intake air) occurs in the air intake passage 21. A part of the intake air flowing backward flows into corresponding one of the downstream distribution passages 45 to 48 via the connecting position A.

Next, the flow of air (EGR gas) in the distribution passage 41 immediately after the intake stroke of the predetermined cylinder 2 and in a period of the first half of the intake stroke of a cylinder 2 in which the intake sequence is next to the predetermined cylinder 2 will be described with reference to FIGS. 5 to 9. In addition, the concentration of the EGR gas is schematically indicated by dots in FIGS. 6 to 9. Moreover, regarding the concentration of the EGR gas to be emphasized, the density of the dots is changed in FIGS. 6 to 9.

Period P1

First, the flow of air (EGR gas) in the distribution passage 41 immediately after the intake stroke of the second cylinder 2*b* (see FIG. 1) illustrated in FIG. 5 and in a period P1 of the first half of the intake stroke of the first cylinder 2*a* (see FIG. 1) in which the intake sequence is next to the second cylinder 2*b* will be described. Moreover, the period P1 is an example of the "first period" of the claims.

As illustrated in FIG. 6, in an air intake passage 21*b* connected to the second cylinder 2*b* immediately after the intake stroke, a part of the intake air flows backward to the downstream distribution passage 46 connected to the air intake passages 21*b* by the generated intake air pulsation. As a result, in the period P1, the air intake passage 21*b* is in the positive pressure state. In the downstream distribution passage 46, the EGR gas is pushed toward the upstream side (the connecting position B1 and the midstream distribution passage 43) by the intake air which flows backward.

On the other hand, since an air intake passage 21*a* is in the first half of the intake stroke in the corresponding first cylinder 2*a*, it is in the negative pressure state. As a result, in the downstream distribution passage 45 branched off from the same midstream distribution passage 43 as the downstream distribution passage 46, a flow of air (EGR gas) from the downstream distribution passage 45 to the air intake passage 21*a* is generated. Therefore, a degree of decrease in the concentration of the EGR gas in the downstream distribution passage 46 increases. A part of the EGR gas pushed out in the downstream distribution passage 46 flows into the air intake passage 21*a* (first cylinder 2*a*) via the downstream distribution passage 45 by the flow generated in the downstream distribution passage 45.

Here, in the embodiment, as described above, the connecting passage 49 connecting the downstream distribution passage 46 and the downstream distribution passage 47 is provided in the distribution passage 41. Therefore, a part of the EGR gas pushed out in the downstream distribution passage 46 flows into the connecting passage 49 via the connecting position B1 between the downstream distribution passage 46 and the connecting passage 49. As a result, the concentration of the EGR gas in the downstream distribution passage 47 is increased by the EGR gas reaching the downstream distribution passage 47 from the downstream distribution passage 46 via the connecting passage 49. In this case, the connecting position B1 faces the connecting position A2 between the downstream distribution passage 46 and the air intake passage 21*b* in the Z-axis direction. Therefore, the EGR gas is likely to flow into the connecting passage 49.

In addition, a part of the EGR gas pushed out in the downstream distribution passage 46 flows into the connecting passage 49 and thereby it is possible to decrease the amount of the EGR gas flowing into the air intake passage 21*a* (first cylinder 2*a*) via the downstream distribution passage 45.

Period P2

Next, the flow of air (EGR gas) in the distribution passage 41 immediately after the intake stroke of the first cylinder 2*a* illustrated in FIG. 7 and in a period P2 of the first half of the intake stroke of the third cylinder 2*c* (see FIG. 1) in which the intake sequence is next to the first cylinder 2*a* will be described.

Figure 7:
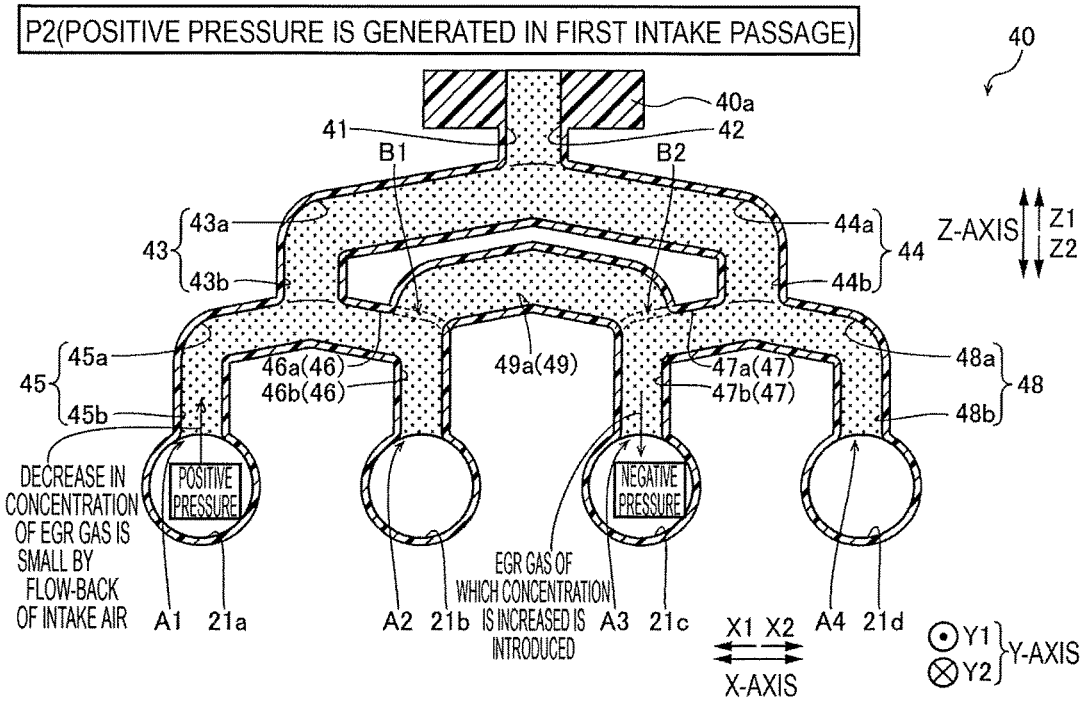
FIG. 7 is a schematic sectional view for explaining a behavior of EGR gas in a distribution passage in a period P2 of the in-line four-cylinder engine of an embodiment disclosed here.

As illustrated in FIG. 7, in the air intake passages 21*a* connected to the first cylinder 2*a* immediately after the intake stroke, a part of the intake air flows backward to the downstream distribution passage 45 connected to the air intake passages 21*a* by the generated intake air pulsation. That is, the air intake passage 21*a* is in the positive pressure state. In the downstream distribution passage 45, the EGR gas is pushed toward the upstream side (midstream distribution passage 43) by the intake air which flows backward.

On the other hand, since an air intake passage 21*c* is in the first half of the intake stroke in the corresponding third cylinder 2*c*, it is in the negative pressure state. However, since the downstream distribution passage 47 connected to the air intake passage 21*c* is connected to the midstream distribution passage 44 different from the downstream distribution passage 45 connected to the air intake passage 21*a* in which the positive pressure is generated, the flow from the downstream distribution passage 45 to the downstream distribution passage 47 is smaller than that in the period P1. Therefore, the degree of the decrease in the concentration of the EGR gas in the downstream distribution passage 45 decreases compared to that in the period P1.

Moreover, in the period P1, since the concentration of the EGR gas in the downstream distribution passage 47 increases, the concentration of the EGR gas flowing into the corresponding air intake passage 21*c* (third cylinder 2*c*) may be increased in the period P2 next to the period P1.

Period P3

Next, the flow of air (EGR gas) in the distribution passage 41 immediately after the intake stroke of the third cylinder 2*c* illustrated in FIG. 8 and in a period P3 of the first half of the intake stroke of the fourth cylinder 2*d* (see FIG. 1) in which the intake sequence is next to the third cylinder 2*c* will be described. Here, the flow of air in the distribution passage 41 in the period P3 is such that the downstream distribution passage 46, the air intake passage 21*b*, and the second cylinder 2*b* in the period P1 are respectively the same as the downstream distribution passage 47, the air intake passage 21*c*, and the third cylinder 2*c*, and the downstream distribution passage 45, the air intake passage 21*a*, and the first cylinder 2*a* in the period P1 are respectively the same as the downstream distribution passage 48, the air intake passage 21*d*, and the fourth cylinder 2*d*. Moreover, the period P3 is an example of the "second period" of the claims.

Figure 8:
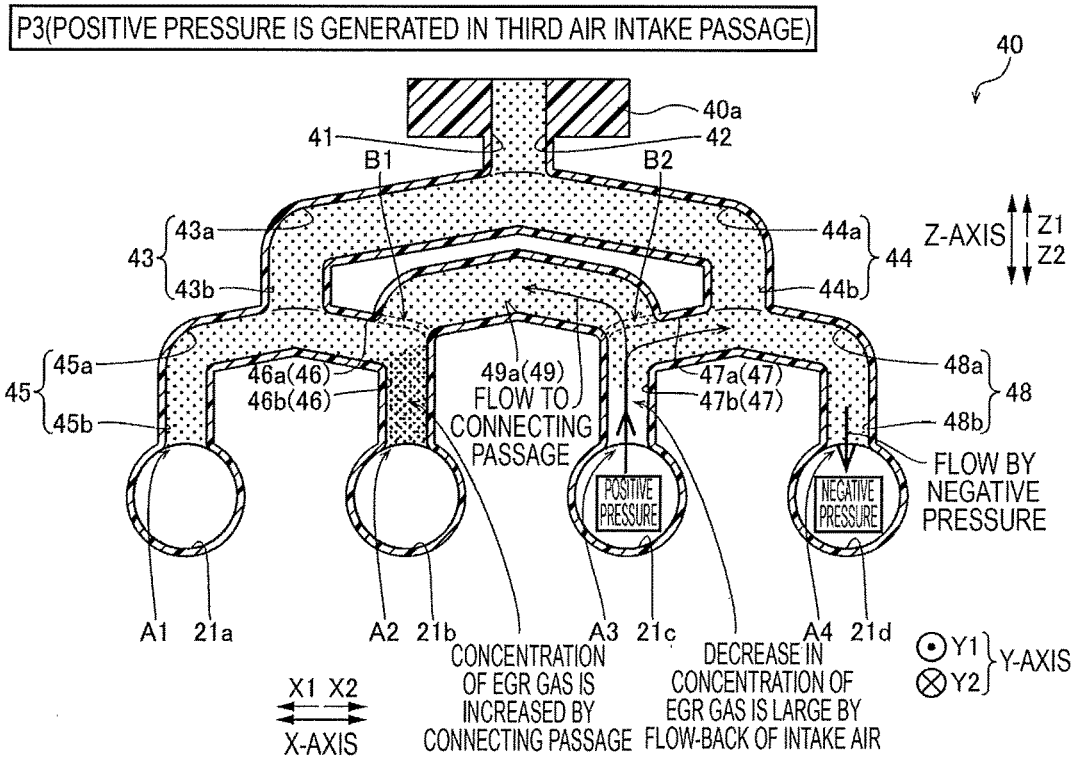
FIG. 8 is a schematic sectional view for explaining a behavior of EGR gas in a distribution passage in a period P3 of the in-line four-cylinder engine of an embodiment disclosed here.

That is, as illustrated in FIG. 8, a part of the intake air flows backward in the air intake passage 21*c* connected to the third cylinder 2*c* immediately after the intake stroke. As a result, in the period P3, the air intake passage 21*c* is in the positive pressure state. The concentration of the EGR gas in the downstream distribution passage 47 is decreased by the intake air which flows backward in the downstream distribution passage 47. On the other hand, since the air intake passage 21*d* is in the first half of the intake stroke in the corresponding fourth cylinder 2*d*, it is in the negative pressure state. As a result, in the downstream distribution passage 48 branched off from the same midstream distribution passage 44 as the downstream distribution passage 47, the flow of air (EGR gas) is generated from the downstream distribution passage 48 to the air intake passage 21*d*. Therefore, the degree of the decrease in the concentration of the EGR gas in the downstream distribution passage 47 increases. A part of the EGR gas pushed out in the downstream distribution passage 47 flows into the air intake passage 21*d* (fourth cylinder 2*d*) via the downstream distribution passage 48 by the flow generated in the downstream distribution passage 48.

Here, a part of the EGR gas pushed out in the downstream distribution passage 47 flows into the connecting passage 49 via the connecting position B2 between the downstream distribution passage 47 and the connecting passage 49. As a result, the concentration of the EGR gas in the downstream distribution passage 46 is increased by the EGR gas reaching the downstream distribution passage 46 from the downstream distribution passage 47 via the connecting passage 49. In this case, the connecting position B2 faces the connecting position A3 between the downstream distribution passage 47 and the air intake passage 21*c* in the Z-axis direction. Therefore, the EGR gas is likely to flow into the connecting passage 49.

In addition, a part of the EGR gas pushed out in the downstream distribution passage 47 flows into the connecting passage 49 and thereby it is possible to decrease the amount of the EGR gas flowing into the air intake passage 21*d* (fourth cylinder 2*d*) via the downstream distribution passage 48.

Period P4

Next, the flow of air (EGR gas) in the distribution passage 41 immediately after the intake stroke of the fourth cylinder 2*d* illustrated in FIG. 9 and in a period P4 of the first half of the intake stroke of the second cylinder 2*b* in which the intake sequence is next to the fourth cylinder 2*d* will be described. Here, the flow of air in the distribution passage 41 in the period P4 is such that the downstream distribution passage 45, the air intake passage 21*a*, and the first cylinder 2*a* in the period P2 are respectively the same as the downstream distribution passage 48, the air intake passage 21*d*, and the fourth cylinder 2*d*, and the downstream distribution passage 47, the air intake passage 21*c*, and the third cylinder 2*c* in the period P2 are respectively the same as the downstream distribution passage 46, the air intake passage 21*b*, and the second cylinder 2*b*.

Figure 9:
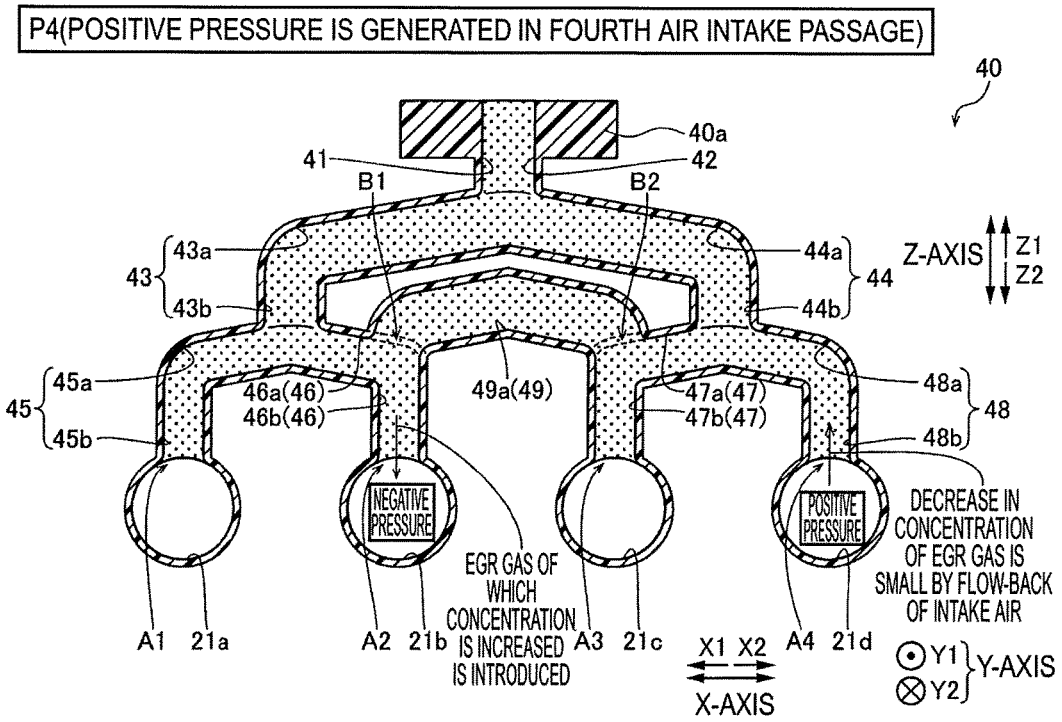
FIG. 9 is a schematic sectional view for explaining a behavior of EGR gas in a distribution passage in a period P4 of the in-line four-cylinder engine of an embodiment disclosed here.

That is, as illustrated in FIG. 9, a part of the intake air flows backward and thereby the air intake passage 21*d* connected to the fourth cylinder 2*d* immediately after the intake stroke is in the positive pressure state. On the other hand, since the air intake passage 21*b* is in the first half of the intake stroke in the corresponding second cylinder 2*b*, it is in the negative pressure state. However, since the downstream distribution passage 46 connected to the air intake passage 21*b* is connected to the midstream distribution passage 43 different from the downstream distribution passage 48 connected to the air intake passage 21*d* in which the positive pressure is generated, the flow from the downstream distribution passage 48 to the downstream distribution passage 46 is smaller than that in the period P3. Therefore, the degree of the decrease in the concentration of the EGR gas in the downstream distribution passage 48 decreases compared to that in the period P3.

Moreover, in the period P3, since the concentration of the EGR gas in the downstream distribution passage 46 increases, the concentration of the EGR gas flowing into the corresponding air intake passage 21*b* (second cylinder 2*b*) may be increased in the period P1 next to the period P4.

As a result, in the period P1, a part of the EGR gas flowing into the downstream distribution passage 45 (air intake passage 21*a*) into which a large amount of the EGR gas easily flowing is moved to the downstream distribution passage 47 via the connecting passage 49. Therefore, it is possible to decrease the amount of the EGR gas flowing into the first cylinder 2*a*. In addition, in the period P1, a part of the EGR gas is moved to the downstream distribution passage 47 (air intake passage 21*c*) into which the EGR gas does not flow too much via the connecting passage 49. Therefore, in the period P2, it is possible to increase the amount of the EGR gas flowing into the third cylinder 2*c*.

Similarly, in the period P3, a part of the EGR gas flowing into the downstream distribution passage 48 (air intake passage 21*d*) into which a large amount of the EGR gas easily flows is moved to the downstream distribution passage 46 via the connecting passage 49. Therefore, it is possible to decrease the amount of the EGR gas flowing into the fourth cylinder 2*d*. In addition, in the period P3, a part of the EGR gas is moved to the downstream distribution passage 46 (air intake passage 21*b*) into which the EGR gas does not flow too much via the connecting passage 49. Therefore, it is possible to increase the amount of the EGR gas flowing into the second cylinder 2*b* in the period P4.

In addition, even in a case where a magnitude of the intake air pulsation due to a difference in operation conditions (engine speed, engine load, and the like) of the in-line four-cylinder engine 1 varies for each cylinder 2 (particularly, in a case where the amount of the EGR gas distributed to the first cylinder 2*a* or the fourth cylinder 2*d* is large), it is possible to effectively suppress an increase in the variation of the distribution of the EGR gas to the four cylinders 2 (the first cylinder 2*a*, the second cylinder 2*b*, the third cylinder 2*c*, and the fourth cylinder 2*d*) by the connecting passage 49.

Therefore, as in the air intake apparatus 100 of the embodiment, in a case where each of a pair of cylinders (air intake passages), in which the intake stroke is continuous, is connected to the downstream distribution passage branched off from the same midstream distribution passage, the connecting passage connecting the downstream distribution passage of the other cylinder (previous cylinder) in which the intake stroke is performed before one cylinder (succeeding cylinder) and the downstream distribution passage branched off from the midstream distribution passage different from the above-described midstream distribution passage is provided. Therefore, it is possible to decrease the amount of the EGR gas distributed to the succeeding cylinder. Furthermore, the downstream distribution passages of the previous cylinder are connected by the connecting passage. Therefore, it is possible to increase the amount of the EGR gas distributed to the previous cylinder. As a result, it is possible to effectively suppress the variation of the amount of the EGR gas distributed to each cylinder.

Effects of Embodiment

In the embodiment, it is possible to obtain the following effects.

In the embodiment, as described above, the distribution passage 41 is provided with the connecting passage 49 connecting the downstream distribution passage 46 and the downstream distribution passage 47 adjacent to the downstream distribution passage 46. Therefore, when the flow of the EGR gas is formed from the downstream distribution passage 46 to the downstream distribution passage 45, by the connecting passage 49, a part of the EGR gas from the downstream distribution passage 46 to the downstream distribution passage 45 can be escaped to the downstream distribution passage 47 via the connecting passage 49. As a result, it is possible to decrease the amount of the EGR gas supplied from the downstream distribution passage 45 to the air intake passage 21*a* and to increase the amount of the EGR gas supplied from the downstream distribution passage 47 to the air intake passage 21*c*. In addition, when the flow of the EGR gas is formed from the downstream distribution passage 47 to the downstream distribution passage 48, by the connecting passage 49, a part of the EGR gas from the downstream distribution passage 47 to the downstream distribution passage 48 can be escaped to the downstream distribution passage 46 via the connecting passage 49. As a result, it is possible to decrease the amount of the EGR gas supplied from the downstream distribution passage 48 to the air intake passage 21*d* and to increase the amount of the EGR gas supplied from the downstream distribution passage 46 to the air intake passage 21*b*. Therefore, it is possible to decrease the EGR gas distributed to the air intake passage 21*a* (first cylinder 2*a*) and the air intake passage 21*d* (fourth cylinder 2*d*) to which a large amount of the EGR gas is likely to distributed by the intake air pulsation, and to increase the EGR gas distributed to the air intake passage 21*b* (second cylinder 2*b*) and the air intake passage 21*c* (third cylinder 2*c*) to which a small amount of the EGR gas is likely to be distributed. Therefore, in the distribution passage 41 formed in the tournament branch shape, it is possible to effectively suppress occurrence of variation in the distribution of the EGR gas to the four cylinders 2 (the first cylinder 2*a*, the second cylinder 2*b*, the third cylinder 2*c*, and the fourth cylinder 2*d*). As a result, when the amount of the EGR gas introduced into the in-line four-cylinder engine 1 to which the air intake apparatus 100 is attached is increased, since the EGR gas is further uniformly distributed to each cylinder 2, in all cylinders 2, a pressure (negative pressure) acting on the air intake passage 21 during the intake stroke can be increased to the same extent (close to a positive pressure). Therefore, when the amount of the introduced EGR gas is increased, in all the air intake passages 21, it is possible to decrease a difference between a pressure during the intake stroke and a pressure during an exhaust stroke. Therefore, it is possible to decrease a pumping loss in the entire in-line four-cylinder engine 1.

In addition, in the embodiment, the connecting position B1 between the connecting passage 49 and the downstream distribution passage 46 is located at a position facing the connecting position A2 between the air intake passage 21*b* and the downstream distribution passage 46, and the connecting position B2 between the connecting passage 49 and the downstream distribution passage 47 is located at a position facing the connecting position A3 between the air intake passage 21*c* and the downstream distribution passage 47. Therefore, it is possible to easily guide the flow caused by the intake air flowing into the downstream distribution passage 46 from the connecting position A2 between the air intake passage 21*b* and the downstream distribution passage 46 to the connecting position B1 between the connecting passage 49 and the downstream distribution passage 46, facing the connecting position A2 between the air intake passage 21*b* and the downstream distribution passage 46. Similarly, it is possible to easily guide the flow caused by the intake air flowing into the downstream distribution passage 47 from the connecting position A3 between the air intake passage 21*c* and the downstream distribution passage 47 to the connecting position B2 between the connecting passage 49 and the downstream distribution passage 47, facing the connecting position A3 between the air intake passage 21*c* and the downstream distribution passage 47. As a result, it is possible to cause a part of the EGR gas from the downstream distribution passage 46 to the downstream distribution passage 45, to easily flow through the connecting passage 49, and to cause a part of the EGR gas from the downstream distribution passage 47 to the downstream distribution passage 48, to easily flow through the connecting passage 49.

In addition, in the embodiment, the passage cross-sectional area of the connecting passage 49 is larger than a passage cross-sectional area of the downstream distribution passage 46 and the passage cross-sectional area of the downstream distribution passage 47. Therefore, it is possible to cause a part of the EGR gas from the downstream distribution passage 46 to the downstream distribution passage 45, to easily flow through the connecting passage 49 having the large passage cross-sectional area, and to cause a part of the EGR gas from the downstream distribution passage 47 to the downstream distribution passage 48, to easily flow through the connecting passage 49 having the large passage cross-sectional area.

In addition, in the embodiment, the center portion 49*a* in the X-axis direction in which the connecting passage 49 extends is disposed at the position higher than the connecting position B1 between the connecting passage 49 and the downstream distribution passage 46 and higher than the connecting position B2 between the connecting passage 49 and the downstream distribution passage 47. Therefore, it is possible to suppress accumulation and deposition of a liquid component, foreign matters, or the like caused by the EGR gas at the center portion 49*a* unlike a case where the center portion 49*a* is disposed at the connecting position B1 between the connecting passage 49 and the downstream distribution passage 46, or the position lower than the connecting position B2 between the connecting passage 49 and the downstream distribution passage 47.

In addition, in the embodiment, in the period P1 in which the air intake passage 21*b* is in the positive pressure state due to the intake air pulsation and the air intake passage 21*a* is in the negative pressure state, the flow of the EGR gas from the air intake passage 21*b* to the air intake passage 21*a* is formed in the distribution passage 41. Similarly, in the period P3 in which the air intake passage 21*c* is in the positive pressure state due to the intake air pulsation and the air intake passage 21*d* is in the negative pressure state, the flow of the EGR gas from the air intake passage 21*c* to the air intake passage 21*d* is formed in the distribution passage 41. In such a case, the distribution passage 41 is provided with the connecting passage 49 connecting the downstream distribution passage 46 and the downstream distribution passage 47 adjacent to the downstream distribution passage 46. Therefore, it is possible to decrease the EGR gas distributed to the air intake passage 21*a* (first cylinder 2*a*) and the air intake passage 21*d* (fourth cylinder 2*d*) to which a large amount of the EGR gas is distributed, and to increase the EGR gas distributed to the air intake passage 21*b* (second cylinder 2*b*) and the air intake passage 21*c* (third cylinder 2*c*) to which a small amount of the EGR gas is distributed. As a result, in the distribution passage 41 formed in the tournament branch shape, it is possible to effectively suppress occurrence of variation in the distribution of the EGR gas to the four cylinders 2 (the first cylinder 2*a*, the second cylinder 2*b*, the third cylinder 2*c*, and the fourth cylinder 2*d*).

In addition, in the embodiment, the period P1 is a period in which the first cylinder 2*a* is in the first half of the intake stroke and the second cylinder 2*b* is immediately after the intake stroke. Therefore, in the period P1, it is possible to reliably cause the air intake passage 21*b* to be in the positive pressure state due to the intake air pulsation and the air intake passage 21*a* to be in the negative pressure state. As a result, it is possible to decrease the EGR gas distributed to the air intake passage 21*a* (first cylinder 2*a*) to which a large amount of the EGR gas is distributed by providing the connecting passage 49.

In addition, in the embodiment, the period P3 is a period in which the fourth cylinder 2*d* is in the first half of the intake stroke and the third cylinder 2*c* is in immediately after the intake stroke. Therefore, in the period P3, it is possible to reliably cause the air intake passage 21*c* to be in the positive pressure state due to the intake air pulsation and the air intake passage 21*d* to be in the negative pressure state. As a result, it is possible to decrease the EGR gas distributed to the air intake passage 21*d* (fourth cylinder 2*d*) to which a large amount of the EGR gas is distributed by providing the connecting passage 49.

In addition, in the embodiment, the distribution passage 41 of the air intake apparatus 100 attached to the in-line four-cylinder engine 1 having one group of the cylinder group 102 is provided with the connecting passage 49 connecting the downstream distribution passage 46 and the downstream distribution passage 47 adjacent to the downstream distribution passage 46. Therefore, it is possible to effectively suppress occurrence of variation in the distribution of the EGR gas to the four cylinders 2 (the first cylinder 2*a*, the second cylinder 2*b*, the third cylinder 2*c*, and the fourth cylinder 2*d*) of the in-line four-cylinder engine 1.

In addition, in the embodiment, the upstream distribution passage 42 is located above the midstream distribution passages 43 and 44, the midstream distribution passage 43 is positioned above the downstream distribution passages 45 and 46, and the midstream distribution passage 44 is positioned above the downstream distribution passages 47 and 48. Therefore, it is possible to suppress accumulation and deposition of the liquid component, the foreign matters, or the like caused by the EGR gas in the distribution passage 41.

In addition, in the embodiment, the connecting passage 49 is inclined downward from the center portion 49*a* of the connecting passage 49 toward the connecting position B1 to the downstream distribution passage 46, and is inclined downward from the center portion 49*a* toward the connecting position B2 to the downstream distribution passage 47. Therefore, it is possible to move the liquid component, the foreign matters, or the like from the center portion 49*a* to the connecting position B1 or B2 by gravity. As a result, it is possible to further suppress accumulation and deposition of the liquid component, the foreign matters, or the like in the connecting passage 49.

In addition, in the embodiment, the passage cross-sectional area of the connecting passage 49 is larger than the passage cross-sectional area of the midstream distribution passage 43. Therefore, it is possible to suppress a decrease in a flow speed of the EGR gas flowing from the upstream side (upstream distribution passage 42) to the downstream side (downstream distribution passages 45 and 46) in the midstream distribution passage 43. As a result, it is possible to suppress flowing-back of a part of the EGR gas from the downstream distribution passage 46 to the downstream distribution passage 45 against the EGR gas flowing through the midstream distribution passage 43. Therefore, a part of the EGR gas from the downstream distribution passage 46 to the downstream distribution passage 45 can be effectively escaped to the connecting passage 49.

In addition, in the embodiment, the passage cross-sectional area of the connecting passage 49 is equal to or larger than the passage cross-sectional area of the midstream distribution passage 44. Therefore, a part of the EGR gas from the downstream distribution passage 47 to the downstream distribution passage 48 can be effectively escaped to the connecting passage 49.

MODIFICATION EXAMPLES

Moreover, it is to be understood that the embodiment disclosed this time is examples in all respects and is not restrictive. The scope disclosed here is indicated not by the above description of the embodiment but by the scope of the claims, and includes meanings equivalent to the scope of the claims and all changes (modification examples) within the scope.

Figure 10:
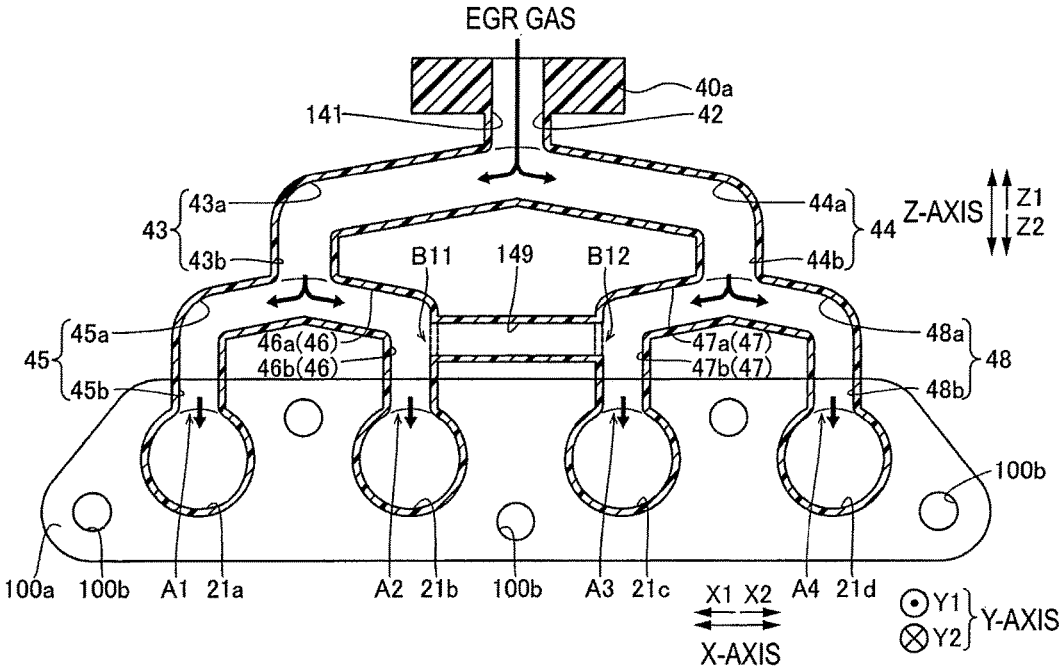
FIG. 10 is a sectional view of an air intake apparatus according to a modification example of an embodiment disclosed here.

For example, in the above-described embodiment, the connecting position B1 between the downstream distribution passage 46 (second downstream distribution passage) and the connecting passage 49 is formed at the position facing the connecting position A2 between the downstream distribution passage 46 and the air intake passage 21*b* in the Z-aids direction. In addition, an example, in which the connecting position B2 between the downstream distribution passage 47 (third downstream distribution passage) and the connecting passage 49 is formed at the position facing the connecting position A3 between the downstream distribution passage 47 and the air intake passage 21*c* in the Z-axis direction, is illustrated, but this disclosure is not limited thereto. In this disclosure, the connecting passage may be formed so as to connect the first downstream distribution passage and the second downstream distribution passage. For example, as in a distribution passage 141 of the embodiment illustrated in FIG. 10, a connecting position B11 between a downstream distribution passage 46 and a connecting passage 149 may be formed at a position not facing a connecting position A2 between the downstream distribution passage 46 and an air intake passage 21*b* in the Z-axis direction, and a connecting position B12 between a downstream distribution passage 47 and the connecting passage 149 may not be formed at a position facing a connecting position A3 between the downstream distribution passage 47 and an air intake passage 21*c* in the Z-axis direction. Moreover, in the modification example of the embodiment, the connecting passage 149 is formed to be at the same height position along the X-axis direction.

In addition, in the above-described embodiment, as the "external gas" of the claims, an example, in which the EGR gas is distributed to a plurality of the air intake passages 21*a* to 21*d* by using the distribution passage 41, is illustrated, but this disclosure is not limited thereto. In this disclosure, as the "external gas" of the claims, gas other than the EGR gas may be distributed to a plurality of air intake passages by using a distribution passage. For example, blow-by gas leaking into the multi-cylinder engine may be distributed to a plurality of the air intake passages by using the distribution passage. In this case, it is possible to effectively suppress occurrence of variation in distribution of the blow-by gas by providing the connecting passage connecting the second downstream distribution passage and the third downstream distribution passage adjacent to each other.

In addition, in the above-described embodiment, an example, in which the distribution passage portion 40 is formed integrally with the air intake passage portion 20, is illustrated, but this disclosure is not limited thereto. In this disclosure, the distribution passage portion and the air intake passage portion may be individually formed.

In addition, in the above-described embodiment, an example, in which the diameters D1 of the midstream distribution passages 43 and 44 (first and second midstream distribution passages) are substantially equal through the entire midstream distribution passages 43 and 44, is illustrated, but this disclosure is not limited thereto. In this disclosure, the diameter (passage cross-sectional area) of the first midstream distribution passage (second midstream distribution passage) may be different through the entire first midstream distribution passage (second midstream distribution passage). For example, the passage cross-sectional area of the first midstream distribution passage (second midstream distribution passage) on the downstream side may be smaller than the passage cross-sectional area thereof on the upstream side. Also by means of this, it is possible to suppress flowing-back of a part of the EGR gas from one downstream distribution passage to another downstream distribution passage against the EGR gas flowing through the first midstream distribution passage (second midstream distribution passage).

In addition, in the above-described embodiment, an example, in which the diameters D2 (passage cross-sectional areas) of the downstream distribution passages 45 to 48 (first to fourth downstream distribution passages) are substantially equal through the entire downstream distribution passages 45 to 48, is illustrated, but this disclosure is not limited thereto. In this disclosure, each of the passage cross-sectional areas of the first to fourth downstream distribution passages may be different through the entire first to fourth downstream distribution passages.

In addition, in the above-described embodiment, an example, in which the diameter D3 (the passage cross-sectional area) of the connecting passage 49 is equal to or larger than the diameters D1 (passage cross-sectional area) of the midstream distribution passages 43 and 44 (first and second midstream distribution passages), and is equal to or larger than the diameters D2 (passage cross-sectional areas) of the downstream distribution passages 45 to 48 (first to fourth downstream distribution passages), is illustrated, but this disclosure is not limited thereto. In this disclosure, the passage cross-sectional area of the connecting passage may be less than the passage cross-sectional areas of the first and second midstream distribution passages. In addition, the passage cross-sectional area of the connecting passage may be equal to or less than the passage cross-sectional areas of the first to fourth downstream distribution passages.

In addition, in the above-described embodiment, an example, in which this disclosure is applied to the air intake apparatus 100 used in the in-line four-cylinder engine 1 having the cylinder group 102 of one group configured with the four cylinders 2, is illustrated, but this disclosure is not limited thereto. In this disclosure, this disclosure may be applied to an air intake apparatus used in an engine having a plurality of cylinder groups configured with four consecutive cylinders. For example, this disclosure may be applied to an air intake apparatus used in a V-type eight-cylinder engine in which cylinder groups of four cylinders face each other, or this disclosure may be applied to an air intake apparatus used in an in-line eight-cylinder engine having eight cylinders (two cylinder groups).

In addition, in the above-described embodiment, an example, in which the "air intake apparatus" of the claims is applied to the in-line four-cylinder engine 1 for vehicle, is illustrated, but this disclosure is not limited thereto. The air intake apparatus disclosed here may be applied to a multi-cylinder engine for other than a vehicle. That is, this disclosure can also be applied to an air intake apparatus used in a multi-cylinder engine installed in transportation equipment such as trains and ships, and further stationary type equipment other than transportation equipment. Moreover, in this case, the multi-cylinder engine needs to have one or a plurality of cylinder groups of four consecutive cylinders.

The inventor of the present application has found that a flow of intake air flowing backward from one air intake passage occurs in one downstream distribution passage connected to one air intake passage due to intake air pulsation of the engine (inertia effect of intake air) as a result of earnest investigations. Furthermore, a flow causing external gas to flow into another downstream distribution passage branched off from the same midstream distribution passage is generated by the flow of the intake air. Therefore, a large amount of the external gas may be distributed to other air intake passages connected to other downstream distribution passages, and thereby the inventor of the present application arrived at this disclosure.

An air intake apparatus according to an aspect of this disclosure includes: an air intake apparatus body that includes a first air intake passage, a second air intake passage, a third air intake passage, and a fourth air intake passage respectively provided corresponding to a first cylinder, a second cylinder, a third cylinder, and a fourth cylinder of a multi-cylinder engine which has one or a plurality of groups of four consecutive cylinders of the first cylinder, the second cylinder, the third cylinder, and the fourth cylinder, the multi-cylinder engine having an air intake sequence of the first cylinder, the third cylinder, the fourth cylinder, and the second cylinder; and a distribution passage through which external gas is distributed to the first air intake passage, the second air intake passage, the third air intake passage, and the fourth air intake passage. The distribution passage includes an upstream distribution passage, a first midstream distribution passage and a second midstream distribution passage which are branched off from the upstream distribution passage, a first downstream distribution passage and a second downstream distribution passage which are branched off from the first midstream distribution passage, and a third downstream distribution passage and a fourth downstream distribution passage which are branched off from the second midstream distribution passage. The first downstream distribution passage, the second downstream distribution passage, the third downstream distribution passage, and the fourth downstream distribution passage are respectively connected to the first air intake passage, the second air intake passage, the third air intake passage, and the fourth air intake passage. The distribution passage further includes a connecting passage that connects the second downstream distribution passage with the third downstream distribution passage adjacent to the second downstream distribution passage.

As described above, in the air intake apparatus according to the aspect of this disclosure, the air intake apparatus body is connected to the multi-cylinder engine of which an intake stroke is performed in the order of the first cylinder, the third cylinder, the fourth cylinder, and the second cylinder. Here, when intake air pulsation occurs in the second air intake passage connected to the second cylinder, the intake air flows backward and thereby the external gas is pushed toward an upstream side (first midstream distribution passage side) in the second downstream distribution passage. On the other hand, in the first downstream distribution passage branched off from the same first midstream distribution passage as the second downstream distribution passage, the intake air is sucked into the first cylinder according to the air intake sequence of the multi-cylinder engine, and thereby the external gas flows toward the first air intake passage. Therefore, in the distribution passage, the flow of the external gas is formed from the second downstream distribution passage to the first downstream distribution passage. Similarly, when the intake air pulsation occurs in the third air intake passage connected to the third cylinder, the intake air flows backward and thereby the external gas is pushed toward the upstream side (second midstream distribution passage side) in the third downstream distribution passage. On the other hand, in the fourth downstream distribution passage branched off from the same second midstream distribution passage as the third downstream distribution passage, the intake air is sucked into the fourth cylinder according to the air intake sequence of the multi-cylinder engine, and thereby the external gas flows toward the fourth air intake passage. Therefore, in the distribution passage, the flow of the external gas is formed from the third downstream distribution passage to the fourth downstream distribution passage.

As described above, in this disclosure, the connecting passage connecting the second downstream distribution passage and the third downstream distribution passage adjacent to the second downstream distribution passage is provided in the distribution passage. Therefore, when the flow of the external gas from the second downstream distribution passage to the first downstream distribution passage is formed, the connecting passage allows a part of the external gas from the second downstream distribution passage to the first downstream distribution passage to escape to the third downstream distribution passage via the connecting passage. As a result, it is possible to decrease an amount of the external gas supplied from the first downstream distribution passage to the first air intake passage and it is possible to increase the amount of the external gas supplied from the third downstream distribution passage to the third air intake passage. In addition, when the flow of the external gas from the third downstream distribution passage to the fourth downstream distribution passage is formed, the connecting passage allows a part of the external gas from the third downstream distribution passage to the fourth downstream distribution passage to escape to the second downstream distribution passage via the connecting passage. As a result, it is possible to decrease the amount of the external gas supplied from the fourth downstream distribution passage to the fourth air intake passage and it is possible to increase the amount of the external gas supplied from the second downstream distribution passage to the second air intake passage. Therefore, it is possible to decrease the external gas distributed to the first air intake passage (first cylinder) and the fourth air intake passage (fourth cylinder) to which a large amount of the external gas is distributed by the intake air pulsation, and it is possible to increase the external gas distributed to the second air intake passage (second cylinder) and the third air intake passage (third cylinder) to which a small amount of the external gas is distributed. Therefore, in the distribution passage formed in a tournament branch shape, it is possible to effectively suppress occurrence of variation in the distribution of the external gas to the four cylinders (first cylinder, the second cylinder, the third cylinder, and the fourth cylinder). As a result, when the amount of the external gas introduced into the multi-cylinder engine, to which the air intake apparatus is attached, is increased, since the external gas is further uniformly distributed to each cylinder, in all cylinders, a pressure (negative pressure) acting on the air intake passage during the intake stroke can be increased to the same extent (close to a positive pressure). Therefore, when the amount of the introduced external gas is increased, in all the air intake passages, it is possible to decrease a difference between a pressure during the intake stroke and a pressure during an exhaust stroke. Therefore, it is possible to decrease a pumping loss in the entire multi-cylinder engine.

In the air intake apparatus according to the above-described one aspect, it is preferable that a connecting position between the connecting passage and the second downstream distribution passage is located at a position facing a connecting position between the second air intake passage and the second downstream distribution passage and that a connecting position between the connecting passage and the third downstream distribution passage is located at a position facing a connecting position between the third air intake passage and the third downstream distribution passage.

With this configuration, it is possible to easily guide the flow caused by the intake air flowing into the second downstream distribution passage from the connecting position between the second air intake passage and the second downstream distribution passage to the connecting position between the connecting passage and the second downstream distribution passage, facing the connecting position between the second air intake passage and the second downstream distribution passage. Similarly, it is possible to easily guide the flow caused by the intake air flowing into the third downstream distribution passage from the connecting position between the third air intake passage and the third downstream distribution passage to the connecting position between the connecting passage and the third downstream distribution passage, facing the connecting position between the third air intake passage and the third downstream distribution passage. Therefore, it is possible to easily circulate a part of the external gas flowing from the second downstream distribution passage to the first downstream distribution passage, to the connecting passage, and to easily circulate a part of the external gas flowing from the third downstream distribution passage to the fourth downstream distribution passage, to the connecting passage.

In the air intake apparatus according to the above-described one aspect, it is preferable that a passage cross-sectional area of the connecting passage is larger than a passage cross-sectional area of the second downstream distribution passage and a passage cross-sectional area of the third downstream distribution passage.

With this configuration, it is possible to easily circulate a part of the external gas flowing from the second downstream distribution passage to the first downstream distribution passage, to the connecting passage having the large passage cross-sectional area, and to easily circulate a part of the external gas flowing from the third downstream distribution passage to the fourth downstream distribution passage, to the connecting passage having the large passage cross-sectional area.

In the air intake apparatus according to the above-described one aspect, it is preferable that a center portion of the connecting passage in a direction in which the connecting passage extends is disposed at a position higher than the connecting position between the connecting passage and the second downstream distribution passage and higher than a connecting position between the connecting passage and the third downstream distribution passage.

With this configuration, it is possible to suppress accumulation and deposition of a liquid component, foreign matters, or the like caused by the external gas at the center portion in the direction in which the connecting passage extends unlike a case where the center portion in the direction in which the connecting passage extends is disposed at the connecting position between the connecting passage and the second downstream distribution passage, or the position lower than the connecting position between the connecting passage and the third downstream distribution passage.

In the air intake apparatus according to the above-described one aspect, it is preferable that the first air intake passage and the second air intake passage are configured to be in a negative pressure state and a positive pressure state respectively in a first period attributed to the air intake sequence of the multi-cylinder engine and that the third air intake passage and the fourth air intake passage are configured to be in a positive pressure state and a negative pressure state respectively in a second period attributed to the air intake sequence of the multi-cylinder engine.

Here, in the first period in which the second air intake passage is in the positive pressure state by the intake air pulsation and the first air intake passage is in the negative pressure state, the flow of the external gas from the second downstream distribution passage to the first downstream distribution passage is formed in the distribution passage. Similarly, in the second period in which the third air intake passage is in the positive pressure state by the intake air pulsation and the fourth air intake passage is in the negative pressure state, the flow of the external gas from the third downstream distribution passage to the fourth downstream distribution passage is formed in the distribution passage. In such a case, since the connecting passage connecting the second downstream distribution passage and the third downstream distribution passage adjacent to the second downstream distribution passage is provided in the distribution passage, it is possible to decrease the external gas distributed to the first air intake passage (first cylinder) and the fourth air intake passage (fourth cylinder) to which a large amount of the external gas is distributed by the intake air pulsation, and it is possible to increase the external gas distributed to the second air intake passage (second cylinder) and the third air intake passage (third cylinder) to which a small amount of the external gas is distributed. As a result, in the distribution passage formed in the tournament branch shape, it is possible to effectively suppress occurrence of variation in the distribution of the external gas to the four cylinders (first cylinder, the second cylinder, the third cylinder, and the fourth cylinder).

Moreover, in the present application, in the air intake apparatus according to the above-described one aspect, the following configurations are also conceivable.

Appendix 1

In a configuration in which the first air intake passage and the second air intake passage are in the negative pressure state and the positive pressure state respectively in the first period, and the third air intake passage and the fourth air intake passage are in the positive pressure state and the negative pressure state respectively in the second period, the first period is a period in which the first cylinder is in a first half of the intake stroke and the second cylinder is in a second half of the intake stroke, and the second period is a period which is immediately after the intake stroke of the third cylinder and in which the fourth cylinder is in the first half of the intake stroke.

Appendix 2

In the air intake apparatus according to the above-described aspect, the multi-cylinder engine is an in-line four-cylinder engine having one group of cylinder groups.

Appendix 3

In the air intake apparatus according to the above-described aspect, the upstream distribution passage is positioned above the first midstream distribution passage and the second midstream distribution passage, the first midstream distribution passage is positioned above the first downstream distribution passage and the second downstream distribution passage, and the second midstream distribution passage is positioned above the third downstream distribution passage and the fourth downstream distribution passage.

Appendix 4

In a configuration in which the center portion of the connecting passage is disposed at the position higher than the connecting position to the downstream distribution passage, the connecting passage is inclined downward from the center portion of the connecting passage to the connecting position to the second downstream distribution passage, and is inclined downward from the center portion to the connecting position to the third downstream distribution passage.

Appendix 5

In a configuration in which the passage cross-sectional area of the connecting passage is larger than the passage cross-sectional area of the second downstream distribution passage and the third downstream distribution passage, the passage cross-sectional area of the connecting passage is equal to or larger than the passage cross-sectional area of the first midstream distribution passage and the passage cross-sectional area of the second midstream distribution passage.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An air intake apparatus comprising:

an air intake apparatus body that includes a first air intake passage, a second air intake passage, a third air intake passage, and a fourth air intake passage respectively provided corresponding to a first cylinder, a second cylinder, a third cylinder, and a fourth cylinder of a multi-cylinder engine which has one or a plurality of groups of four consecutive cylinders of the first cylinder, the second cylinder, the third cylinder, and the fourth cylinder, the multi-cylinder engine having an air intake sequence of the first cylinder, the third cylinder, the fourth cylinder, and the second cylinder; and a distribution passage through which external gas is distributed to the first air intake passage, the second air intake passage, the third air intake passage, and the fourth air intake passage, wherein the distribution passage includes an upstream distribution passage, a first midstream distribution passage and a second midstream distribution passage which are branched off from the upstream distribution passage, a first downstream distribution passage and a second downstream distribution passage which are branched off from the first midstream distribution passage, and a third downstream distribution passage and a fourth downstream distribution passage which are branched off from the second midstream distribution passage, the first downstream distribution passage, the second downstream distribution passage, the third downstream distribution passage, and the fourth downstream distribution passage are respectively connected to the first air intake passage, the second air intake passage, the third air intake passage, and the fourth air intake passage, and the distribution passage further includes a connecting passage that connects the second downstream distribution passage with the third downstream distribution passage adjacent to the second downstream distribution passage.

2. The air intake apparatus according to claim 1, wherein a connecting position between the connecting passage and the second downstream distribution passage is located at a position facing a connecting position between the second air intake passage and the second downstream distribution passage, and a connecting position between the connecting passage and the third downstream distribution passage is located at a position facing a connecting position between the third air intake passage and the third downstream distribution passage.

3. The air intake apparatus according to claim 1, wherein a passage cross-sectional area of the connecting passage is larger than a passage cross-sectional area of the second downstream distribution passage and a passage cross-sectional area of the third downstream distribution passage.

4. The air intake apparatus according to claim 1, wherein a center portion of the connecting passage in a direction in which the connecting passage extends is disposed at a position higher than the connecting position between the connecting passage and the second downstream distribution passage and higher than a connecting position between the connecting passage and the third downstream distribution passage.

5. The air intake apparatus according to claim 1, wherein the first air intake passage and the second air intake passage are configured to be in a negative pressure state and a positive pressure state respectively in a first period attributed to the air intake sequence of the multi-cylinder engine, and the third air intake passage and the fourth air intake passage are configured to be in a positive pressure state and a negative pressure state respectively in a second period attributed to the air intake sequence of the multi-cylinder engine.

* * * * *